US007247992B2

(12) United States Patent
Kornfeld et al.

(10) Patent No.: US 7,247,992 B2
(45) Date of Patent: Jul. 24, 2007

(54) ION ACCELERATOR ARRANGEMENT

(75) Inventors: Günter Kornfeld, Eichingen (DE); Gregory Coustou, Sandillon (FR); Norbert Koch, Ulm (DE)

(73) Assignee: Thales Electron Devices GmbH, Ulm (DE)

( * ) Notice: Subject to any disclaimer, the term of this patent is extended or adjusted under 35 U.S.C. 154(b) by 229 days.

(21) Appl. No.: 10/507,259

(22) PCT Filed: Dec. 13, 2003

(86) PCT No.: PCT/EP03/14210

§ 371 (c)(1),
(2), (4) Date: May 6, 2005

(87) PCT Pub. No.: WO2004/064461

PCT Pub. Date: Jul. 29, 2004

(65) Prior Publication Data

US 2005/0212442 A1 Sep. 29, 2005

(30) Foreign Application Priority Data

Jan. 11, 2003 (DE) ..... 103 00 776

(51) Int. Cl.
*H05B 31/28* (2006.01)

(52) U.S. Cl. ..... 315/111.61; 315/111.51; 313/359.1

(58) Field of Classification Search ..... 315/500, 315/501, 505, 507, 111.21, 111.41, 111.61, 315/111.71, 111.81
See application file for complete search history.

(56) References Cited

U.S. PATENT DOCUMENTS

| | | | | |
|---|---|---|---|---|
| 3,613,370 | A | 10/1971 | Paine | 60/202 |
| 4,495,631 | A | 1/1985 | Lacour et al. | 372/38.05 |
| 5,847,493 | A | 12/1998 | Yashnov et al. | 315/111.61 |
| 6,060,836 | A | 5/2000 | Maeno et al. | 315/111.21 |
| 6,523,338 | B1 * | 2/2003 | Kornfeld et al. | 315/154 |
| 6,803,705 | B2 * | 10/2004 | Kornfeld et al. | 313/231.31 |
| 7,084,572 | B2 * | 8/2006 | Kornfeld et al. | 315/111.61 |

FOREIGN PATENT DOCUMENTS

| | | |
|---|---|---|
| DE | 100 14 033 | 10/2001 |
| DE | 101 30 464 | 1/2003 |
| DE | 198 28 704 | 2/2003 |
| JP | 61 066868 | 4/1986 |
| WO | WO00/01206 | 1/2000 |

* cited by examiner

*Primary Examiner*—Tuyet Vo
*Assistant Examiner*—Ephrem Alemu
(74) *Attorney, Agent, or Firm*—Collard & Roe, P.C.

(57) ABSTRACT

For an ion accelerator system having a special magnetic field structure with an alternating predominantly longitudinal and crosswise progression of the magnetic field, a geometry of the ionization chamber having a non-cylindrical shape of the chamber wall that is adapted to the progression of the magnetic field is proposed.

8 Claims, 2 Drawing Sheets

ION ACCELERATOR ARRANGEMENT

CROSS REFERENCE TO RELATED APPLICATIONS

Figure 1:
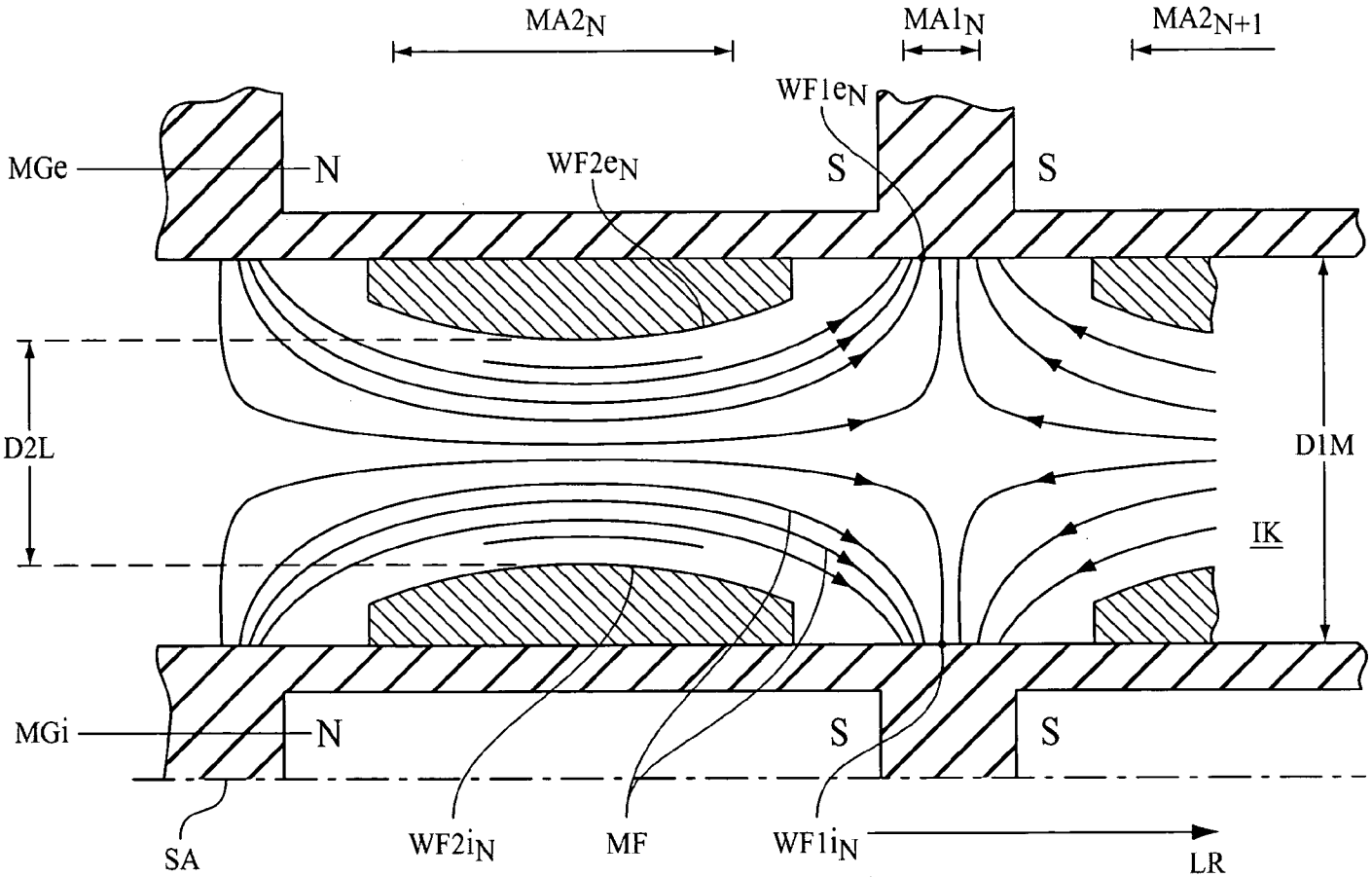

Applicants claim priority under 35 U.S.C. § 119 of German Application No. 103 00 776.8 filed Jan. 11, 2003. Applicants also claim priority under 35 U.S.C. § 365 of PCT/EP03/14210 filed Dec. 13, 2003. The international application under PCT article 21(2) was not published in English.

The invention relates to an ion accelerator system of the type indicated in the preamble of claim 1.

Ion accelerator systems are in use, for example, for surface treatments, particularly in semiconductor technology, or as drives for space missiles. Ions are typically generated from a neutral working gas, for drive purposes, particularly from a noble gas, and accelerated. Two construction principles, in particular, have proven themselves for generating and accelerating ions.

In the case of lattice accelerators, the positively charged ions are extracted from a plasma, by means of a grid system in which a first lattice that borders on the plasma chamber lies at an anode potential, and a second lattice that is offset in the beam exit direction lies at a more negative cathode potential. Such a system is known, for example, from U.S. Pat. No. 3,613,370. The ion stream density of such an accelerator system is limited to low values by means of space charging effects.

Another construction form provides for a plasma chamber, which has an electrical field passing through it, for one thing, to accelerate positively charged ions in the direction of a beam exit opening, and a magnetic field passing through it, for another, for guidance of electrons, which serve to ionize a neutral working gas. In particular, accelerator systems having a ring-shaped plasma chamber, in which the magnetic field runs predominantly radially, and electrons move on closed drift paths, under the influence of the electrical and magnetic fields, have been in use for quite some time. Such an accelerator arrangement is known, for example, from U.S. Pat. No. 5,847,493.

In the case of a new type of ion accelerator system having electrical and magnetic fields in a plasma chamber, the magnetic field demonstrates a particular structure with a field progression that runs predominantly parallel to the longitudinal direction, in longitudinal segments of a second type, and a progression that runs predominantly perpendicular, particularly radially to the longitudinal direction, in longitudinal segments of a first type, which, in particular, also demonstrate a progression of the magnetic field referred to as a cusp. The system is preferably structured in multiple stages, with longitudinal segments of the first and second type following one another alternately. Such ion accelerator systems are known, for example, from DE 100 14 033 A1 or DE 198 28 704 A1. In the case of a plasma accelerator system known from DE 101 30 464 A1, electrodes that project radially inward are provided in the inner wall.

JP 61 066 868 A shows an HF ion generator having an excitation coil arranged on the side walls of a plasma chamber. A permanent magnet arrangement generates a magnetic field having field lines curved around the coil windings, in order to keep plasma away from the coil windings. U.S. Pat. No. 6,060,836 A describes a plasma generator having a hollow conductor that projects axially into a plasma chamber, to which HF power of a magnetron is supplied, and the interior conductor of which carries a permanent magnet arrangement at the end that projects into the chamber.

The present invention is based on the task of further improving the degree of effectiveness of an ion accelerator system.

The invention is described in claim 1. The dependent claims contain advantageous embodiments and further developments of the invention.

The invention proceeds from the magnetic field structure that is known from DE 100 14 033 A1, which has a field direction predominantly parallel to the longitudinal direction in a segment of a second type, in the longitudinal direction of the system, in the ionization (or plasma) chamber, and a comparatively stronger field component, particularly one predominantly perpendicular to the longitudinal direction, in a segment of a first type. The magnetic field continuously and monotonously switches over from a segment of the first type to a segment of the second type that lies adjacent to the former, and vice versa, whereby the adjacent segments of the first and second type can be spaced apart or lie directly next to one another in the longitudinal direction. The longitudinal direction of an ion accelerator system essentially coincides with the average movement direction of the accelerated ions, i.e. an axis of symmetry of the ionization chamber.

By reducing the distance between wall surfaces that lie opposite one another, perpendicular to the longitudinal direction, of the walls that delimit the ionization chamber, in the longitudinal segment of the second type, the volume available to the working gas in this segment is reduced, as compared with an embodiment having a constant distance between the walls and, at the same time, the working gas is concentrated in the center, between the opposite wall surfaces.

It has surprisingly been shown that the overall degree of effectiveness of the system, which particularly includes the degree of effectiveness of ionization and the electrical degree of effectiveness, clearly increases as a result.

Preferably, the distance between opposite wall surfaces in the segment of the second type is reduced, as compared with the distance between walls in an adjacent longitudinal segment of the first type, not only relative to one another but also relative to a center line or center surface, particularly one parallel to the longitudinal direction.

The minimal distance between walls in a longitudinal segment of the second type is at least 15%, preferably at least 20%, particularly at least 25% less than the maximal distance between walls in an adjacent segment of the first type. It is advantageous if at least one, preferably both of the opposite wall surfaces are offset towards the ionization chamber, in a segment of the second type, particularly in the form of a curvature having a wall surface that runs continuously in the longitudinal direction, preferably curved monotonously.

The wall surfaces that stand opposite one another can consist of dielectric material, in insulating manner, or be metallic or partial metallic, particularly in such a manner that a metallic wall surface is present in the segment or segments of the second type, which surface forms an intermediate electrode at a fixed or sliding potential, and is delimited in the longitudinal direction by insulating wall segments, and the wall surfaces in the segments of the first type are electrically insulating.

It is advantageous if the ion accelerator system is structured in multiple stages in the longitudinal progression of the plasma chamber, in such a manner that several segments of the first type follow one another, alternating with segments of the second type, whereby preferably, the longitudinal components in segments of the second type separated by segments of the first type are alternately opposite; the longitudinal component of the magnetic field therefore reverses when passing through a segment of the first type. Such a multi-stage magnetic field structure is actually known from the state of the art. The reduction in the distance between walls that is essential to the invention can then be present in only one, several, or all of the segments of the second type. If the reduction in the distance between walls is present in several or all the segments of the second type, relative to the adjacent segments of the first type, the quantitative extent of the relative reduction can also vary from segment to segment. Preferably, a :reduction in the distance between walls is present at least in the segment of the second type next to the anode, in the longitudinal direction, and/or the reduction is the strongest in this segment, if there is a quantitative variation over several segments.

The anode is preferably arranged at the end of the ionization chamber that lies opposite the exit opening, in the longitudinal direction. The cathode is preferably configured as a primary electron source, from which primary electrons are guided through the ion exit opening into the plasma chamber, and/or which electrons serve to neutralize an ion or plasma beam that exits from the ionization chamber, and is preferably arranged outside of the ionization chamber and laterally offset with reference to the exit opening.

The ion accelerator system according to the invention can serve both to give off a positively charged ion beam and, particularly in the preferred use in the drive of a space vehicle, to give off a neutral plasma beam. In another use, the accelerated ions can particularly be used for the treatment of solid body surfaces and layers close to the surface.

Figure 2:
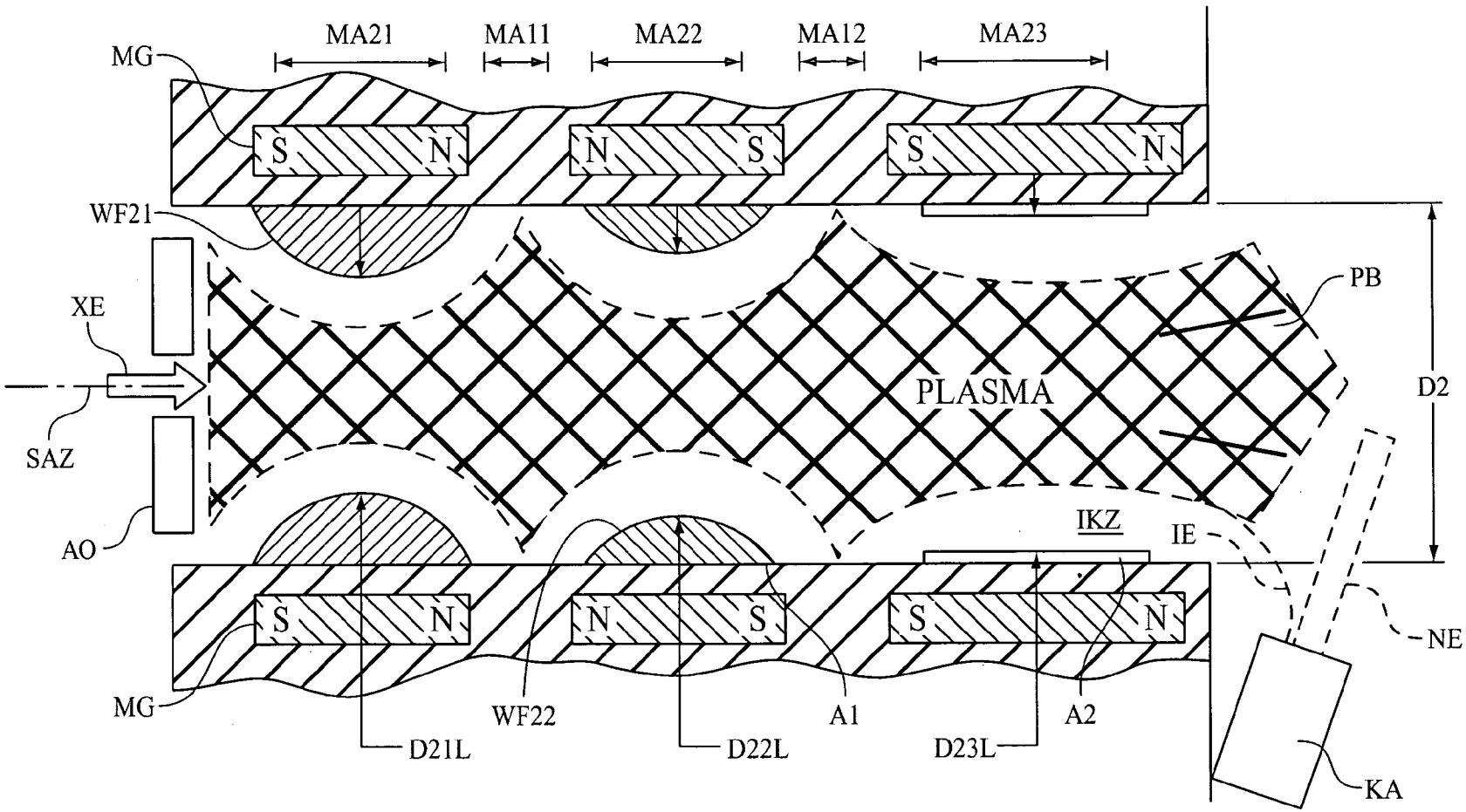

The invention will be explained in greater detail below, using preferred exemplary embodiments, making reference to the figures. These show:

FIG. 1 a magnetic field progression in an ionization chamber,

FIG. 2 a multi-stage system.

In the case of the system shown in FIG. 1, the magnetic field progression in an ionization chamber IK that is presumed for the present invention is shown schematically. The ionization chamber is presumed to be ring shaped, having rotation symmetry about a center longitudinal axis SA, which lies in the longitudinal direction LR of the system. A magnet arrangement MGi that lies radially on the inside and a magnet arrangement MGe that lies radially on the outside generate a magnetic field in the ionization chamber IK, which field has at least one longitudinal segment $MA\mathbf{1}_N$ of a first type and at least one longitudinal segment $MA\mathbf{2}_N$ of a second type, which lies adjacent to the former. Preferably, the magnetic field has several longitudinal segments of the first and second type, which alternately follow one another in the longitudinal direction, as in the example shown in FIG. 2, and as indicated in FIG. 1 by an additional longitudinal segment $MA\mathbf{2}_{N+1}$.

In the longitudinal segment of the second type $MA\mathbf{2}_N$, the magnetic field demonstrates a field direction that is predominantly parallel to the longitudinal axis SA, whereas in the longitudinal segment of the first type $MA\mathbf{1}_N$, the magnetic field possesses a comparatively greater radial component, i.e. a component directed perpendicular to the longitudinal axis. The longitudinal segment of the first type $MA\mathbf{1}_N$ is selected in such a manner, in the example, that the radial field component clearly predominates. Longitudinal segments of the first and second type can be defined to follow one another directly, but in the example shown, in order to clearly distinguish them, with a predominantly longitudinal component in the segment $MA\mathbf{2}_N$, and a predominantly radial component in the longitudinal segment $MA\mathbf{1}_N$, they are spaced apart by means of a transition segment, not indicated in detail. In the longitudinal segment $MA\mathbf{2}_N$ of the second type, the amount of the magnetic flow decreases from the side chamber walls towards the center, just as the magnetic flow at the chamber walls is greater, in the longitudinal segment of the first type, than in the center between opposite wall surfaces. The magnetic field structure described so far is actually known, for example from DE 10014033 A1, as are magnet arrangements for generating such a magnetic field structure.

The field distribution of the magnetic field in FIG. 1 is to be understood as being merely schematic, not quantitative.

It is now essential for the present invention that the radial distance between the wall surfaces $WF\mathbf{2}i_N$, $WF\mathbf{2}e_N$ that stand opposite one another, perpendicular to the longitudinal axis SA in the region of the longitudinal segment $MA\mathbf{2}_N$ of the second type is less than the radial distance between the wall surfaces $WF\mathbf{1}i_N$, $WF\mathbf{1}e_N$ in the longitudinal segment $MA\mathbf{1}_N$ of the first type. The clear radial width of the ionization chamber is therefore reduced in the longitudinal segment $MA\mathbf{2}_N$ of the second type, as compared with the longitudinal segment $MA\mathbf{1}_N$ of the first type.

Preferably, the two wall surfaces $WF\mathbf{2}i_N$, $WF\mathbf{2}e_N$ that stand opposite one another in the longitudinal segment $MA\mathbf{2}_N$ are displaced radially towards the center of the ionization chamber, as compared with the adjacent wall surfaces, in the longitudinal direction, $WF\mathbf{1}i_N$, $WF\mathbf{1}e_N$. As compared with a chamber geometry having the same radial distance between walls in segments of the first and second type, a concentration of the working gas, particularly also of the non-ionized atoms, is therefore forced to come about in the segment $MA\mathbf{2}_N$, in the radially inner region, where a higher electron density and therefore a greater likelihood of ionization is present, because of the lower magnetic flux.

The progression of the wall surfaces in the longitudinal direction can be parallel to the longitudinal axis SA, in each instance, with a step or ramp as a transition. It is preferred, however, at least in the longitudinal segment $MA\mathbf{2}_N$ of the second type, that the progression is not parallel to the longitudinal axis SA, which better approximates the field line progression of the magnetic field in this longitudinal segment and a wall progression parallel to SA. In particular, the wall surface $WF\mathbf{2}i_N$ and/or $WF\mathbf{2}e_N$ can be curved towards the radial center of the ionization chamber, with a minimal wall distance D2L, which increases, in the longitudinal direction, towards the adjacent segment $MA\mathbf{1}_N$ of the first type. The progression of the wall surface $WF\mathbf{2}i_N$ and/or $WF\mathbf{2}e_N$ can, in particular, be curved monotonously, or can be approximated to such a shape, for example with several straight progression parts.

In corresponding manner, the wall surfaces $WF\mathbf{1}i_N$ and/or $WF\mathbf{1}e_N$ can have a straight or curved progression in the longitudinal direction, whereby in the case of these surfaces, a straight progression, parallel to the longitudinal axis, is typical and generally advantageous, for the sake of simplified production.

The radial distance between walls in the longitudinal segment $MA\mathbf{2}_N$ of the second type, i.e. in the case of a wall progression that is not parallel to SA, the minimal radial wall distance D2L there, is preferably at least 15%, preferably at least 20%, particularly at least 25% less than the distance between walls in the adjacent longitudinal segment of the first type, i.e. in the case of a progression not parallel to SA, the maximal wall distance D1M there, i.e. D2L≦0.85 D1M or 0.80 D1M or 0.75 D1M, respectively.

The wall surfaces of the chamber wall can consist of electrically insulating material, or of electrically conductive material, or also partly of electrically conductive material, particularly metal that cannot be magnetized. In a preferred embodiment, the wall surfaces WF2$i_N$, WF2$e_N$ are metallic and the wall surfaces WF1$i_N$, WF1$e_N$ are insulating. The metallic wall surfaces can then advantageously form intermediate electrodes at intermediate potentials between the potentials of an anode and a cathode, as parts of the electrode arrangement, whereby the intermediate potentials can be predetermined or, in the case of insulated, non-contacted intermediate electrodes, can adjust themselves in operation, in sliding manner. In the case of metallic wall surfaces WF2$i_N$, WF2$e_N$, it can also be provided, in particular, that metallic electrodes are set onto or into an essentially cylindrical insulating chamber sleeve, and fixed in place there, or form the wall surfaces WF2$i_N$ and WF2$e_N$, respectively, with their surfaces that face away from the chamber sleeve and towards the ionization chamber and the opposite wall surface.

FIG. 2 shows a multi-stage arrangement in the longitudinal direction, in which several longitudinal segments of the first and second type follow one another alternately in the longitudinal direction, actually in known manner, for example from DE 100 14 033 A1, whereby two segments of the second type (MA2$_N$, MA2$_{N+1}$ in FIG. 1), which are adjacent to a segment of the first type (MA1$_N$ in FIG. 1) that lies between them, demonstrate opposite longitudinal components of the magnetic field. While a ring-shaped chamber geometry about a central center longitudinal axis SA and an inner and an outer magnet arrangement Mgi, Mge are provided in FIG. 1, FIG. 2 is based on a preferred chamber geometry having a simply cohesive cross-sectional surface of the ionization chamber IKZ that contains the center longitudinal axis SAZ, which chamber can, in particular, essentially have rotation symmetry about the center longitudinal axis SAZ that runs parallel to the longitudinal direction. In this case, the magnet arrangement consists, again in known manner, merely of an outer magnet arrangement MG that surrounds the chamber sleeve.

The two wall surfaces that stand opposite one another then belong to the same chamber wall that is closed about the center longitudinal axis SAZ and surrounds the ionization chamber on the sides. The ionization chamber demonstrates a beam exit opening from which a normally slightly divergent ion beam or plasma beam PB exits, with an average ion movement in the longitudinal direction LR. Outside the ionization chamber, at the exit opening AU and laterally offset relative to the latter, there is a cathode KA, as part of the electrode arrangement, which lies at cathode potential and emits electrons. A part IE of these electrons is guided into the ionization chamber by means of the electrical field of the electrode arrangement, and there serves, in known manner, to ionize the working gas and, in this connection, particularly also to generate secondary electrons. Another part NE of the electrons emitted by the cathode can serve to neutralize a positively charged particle stream PB.

In another advantageous embodiment, no external electron source is provided to generate primary electrons for ionizing the gas and/or to neutralize a plasma beam having an excess positive charge. The cathode can then, in particular, be provided by means of a housing part that surrounds the exit opening of the ionization chamber and lies at cathode potential.

An anode A0 as part of the electrode arrangement is arranged at the end of the ionization chamber opposite the exit opening AU in the longitudinal direction LR, and lies at anode potential. A neutral working gas, for drive purposes preferably a heavy noble gas such as xenon (Xe), can be introduced into the ionization chamber, for which purpose a central feed line is entered in the drawing, on the anode side. A typical distribution of a plasma consisting of electrons and positive gas ions is drawn in the ionization chamber, with cross-hatched lines.

The magnet arrangement forms a magnetic field in the ionization chamber IKZ, which field has longitudinal segments MA11, MA12 of the first type and longitudinal segments MA21, MA22, MA23 of the second type, which alternately follow one another, in the longitudinal direction. Let us assume that, as shown, the distance between opposite wall surfaces, which is equal to the diameter of the ionization chamber, in this case, is constant and equal to DZ in all the longitudinal segments of the first type as well as in any transition segments that might be present.

In the example shown, which shows several configuration variants for the longitudinal segments MA21, MA22, MA23 of the second type, in order to provide a better illustration, the ionization chamber is narrowed to a minimal diameter D21L in the longitudinal segment MA21, by means of a convex curvature that surrounds the central longitudinal axis in ring shape, having a wall surface WF21. Let us assume that the wall surface WF21 is electrically insulating. In the longitudinal segment MA22, the diameter of the ionization chamber is reduced to a value D22L, whereby any expansion of the plasma in the second stage, as compared with the first stage, can be taken into account by sizing D22L to be bigger than D21L, and the wall losses that negatively affect the electrical degree of effectiveness can be kept low. Let the wall surface WF22 or the entire diameter narrowing at this distance be metallic and form a first intermediate electrode A1 at a fixed intermediate potential. Finally, in the segment MA23, an electrode A2 having a low radial thickness is provided, which reduced the diameter D23L in this segment not at all or only negligibly, as compared with DZ, and which assumes an intermediate potential in operation, in sliding manner, without being contacted. The electrode arrangement can also deviate, in its division in the longitudinal direction, from the division of the magnetic field into longitudinal segments of the first and second type.

The characteristics indicated above and in the claims, as well as evident from the drawings, can be advantageously implemented both individually and in various combinations. The invention is not restricted to the exemplary embodiments described, but rather can be modified in many different ways, within the scope of the ability of a person skilled in the art. In particular, the wall surfaces in the segments of the second type can be formed in different other ways and, in this connection, can be insulating, electrically conductive, or also electrically conductive only in partial areas. The dimensions of the individual longitudinal segments and/or the intermediate electrodes can vary from stage to stage. Characteristics of known ion accelerator systems can be combined with the characteristics essential to the invention. The cross-section of the ionization chamber can also deviate from a shape having rotation symmetry, and can assume an elongated shape.

The invention claimed is:

1. Ion accelerator system having an ionization chamber, an electrode arrangement, and a magnet arrangement, wherein the ionization chamber has an ion exit opening in a longitudinal direction, and is delimited by at least one side wall crosswise to the longitudinal direction, and wherein working gas can be introduced into the ionization chamber by way of an introduction opening that is spaced at a distance from the exit opening, the electrode arrangement contains at least one cathode and one anode, and generates an electrical field for accelerating positively charged working gas ions in the direction of the exit opening, the magnet arrangement in the ionization chamber generates a magnetic field that has, in the longitudinal direction, at least one longitudinal segment of a second type, having a magnetic field direction essentially parallel to the longitudinal direction, and an adjacent longitudinal segment of a first type, having a comparatively higher proportion of the field component perpendicular to the longitudinal direction, the wall distance between wall surfaces that stand opposite one another is less in the longitudinal segment of the second type than in the longitudinal segment of the first type, wherein the wall progression in the longitudinal segment of the second type demonstrates a monotonously curved curvature towards the ionization chamber, in the longitudinal direction.

2. System according to claim 1, wherein the minimal distance between walls in the longitudinal segment of the second type is at least 15%, particularly at least 25%, less than the maximal distance between walls in the longitudinal segment of the first type.

3. System according to claim 1, wherein longitudinal segments of the first and the second type alternately follow one another.

4. System according to claim 1, wherein a reversal of direction of the longitudinal component of the magnet occurs in a longitudinal segment of the first type.

5. System according to claim 1, wherein in a longitudinal segment of the second type, the chamber wall is formed at least partly by an intermediate electrode.

6. System according to claim 1, wherein the anode is arranged at the end of the ionization chamber that lies opposite the exit opening, in the longitudinal direction.

7. System according to claim 1, wherein the cathode is configured as a primary electron source and is arranged laterally offset with reference to the exit opening, outside of the ionization chamber.

8. System according to claim 1, wherein no external electron source is provided as a neutralizer or primary electron source.

* * * * *